US007059624B2

(12) United States Patent
Compton

(10) Patent No.: US 7,059,624 B2
(45) Date of Patent: Jun. 13, 2006

(54) SNOWBOARD ACCESSORY

(76) Inventor: Chad S. Compton, 2609 Florida St., #3, Huntington Beach, CA (US) 92647

( * ) Notice: Subject to any disclaimer, the term of this patent is extended or adjusted under 35 U.S.C. 154(b) by 147 days.

(21) Appl. No.: 10/193,887

(22) Filed: Jul. 12, 2002

(65) Prior Publication Data

US 2003/0011172 A1 Jan. 16, 2003

Related U.S. Application Data

(60) Provisional application No. 60/304,915, filed on Jul. 12, 2001.

(51) Int. Cl.
*A63C 9/10* (2006.01)

(52) U.S. Cl. ..... 280/626; 280/619

(58) Field of Classification Search ..... 280/607, 280/617, 618, 14.21, 14.22, 14.23, 14.24, 280/633, 634, 809; 441/70; 24/484, 265 A, 24/DIG. 43

See application file for complete search history.

(56) References Cited

U.S. PATENT DOCUMENTS 3,501,814 A * 3/1970 Anderson et al. ..... 24/16 PB
4,592,734 A * 6/1986 Metiver ..... 441/74
5,836,091 A 11/1998 Cook
6,065,770 A * 5/2000 Hansen et al. ..... 280/617
6,217,071 B1 4/2001 Shia
6,217,073 B1 4/2001 Hoffman
6,224,070 B1 * 5/2001 Carpenter et al. ..... 280/14.21
6,247,728 B1 6/2001 Verville
6,321,470 B1 11/2001 Zazzi
6,349,904 B1 * 2/2002 Polad ..... 248/74.3
6,390,492 B1 * 5/2002 Bumgarner et al. ..... 280/607
6,416,075 B1 * 7/2002 Laughlin et al. ..... 280/624
6,422,048 B1 * 7/2002 Fontes et al. ..... 70/58
6,631,919 B1 * 10/2003 West et al. ..... 280/633
2003/0094790 A1 * 5/2003 Poscich ..... 280/618
2004/0032122 A1 * 2/2004 Giannulli ..... 280/809

FOREIGN PATENT DOCUMENTS

WO WO 01/19458 A1 3/2001

* cited by examiner

*Primary Examiner*—Christopher P. Ellis
*Assistant Examiner*—Brian Swenson

(57) ABSTRACT

The present invention comprises an apparatus, namely, a snowboard accessory, which comprises a base and first and second straps operatively connected to the base. The straps are selectively removable from the base. The straps are adapted to secure a snowboarder's left foot to the base. Further, the straps are reversible such that a snowboarder's right foot can be attached to the base. Accordingly, it an object of the present invention to provide a toe-hook apparatus that is reversible such that a regular-footed rider or a goofy-footed rider may relieve stress on their knees and ankles when riding a chair lift.

17 Claims, 9 Drawing Sheets

SNOWBOARD ACCESSORY

This utility application claims priority from a provisional application having Ser. No. 60/304,915, filed on Jul. 12, 2001.

1. BACKGROUND OF THE INVENTION

A. Field of Invention

This invention pertains to the art of methods and apparatuses for snowboard accessories, and more specifically to the art of methods and apparatuses for a reversible toe-hook for a snowboard.

B. Description of the Related Art

The sport of snowboarding has been increasing in popularity over the years. People of all ages enjoy the exciting thrill of speeding down a hill on a snowboard. A snowboard generally includes a board, which is similar to a skateboard. It has forward and rear bindings to secure the snowboarder's feet to the board as the snowboarder travels down the hill or mountain. Like skiing, snowboarders usually ride a chair lift to the top of a hill before they can embark on their adventure. However, most resorts forbid both feet from being secured to the snowboard during the lift ride. Since only one foot is secured to the snowboard, usually the foot in the front binding, undue stress is placed on the knee and ankle since the entire weight of the snowboard is carried on one leg and foot, rather than being evenly distributed by both feet.

Another problem the snowboarder encounters is the lack of control he or she has as they exit the lift. Generally, both feet need to be secured to the snowboard so that the snowboarder can control their direction and balance as they exit the lift. This becomes difficult if the rear foot is not bound to the snowboard.

One effort has been made to solve these reoccurring problems. THE STRAP PAD®, distributed by Type 3 Innovative Accessories, of Santa Monica, Calif., adhesively attaches a base to the snowboard in front of the rear binding and comprises two eyelets on either side for receiving a nylon strap that is adjusted through a hook and loop type fastener. The two loops and strap are positioned in about the front third of the base so that a snowboarder's foot may slide under the strap to evenly distribute the weight of the snowboard between both feet.

Several problems exist with the current products available to solve the aforementioned problem. First, while most riders ride their snowboards "regular-footed," meaning with the left foot in the front binding and the right foot in the rear binding, many snowboarders ride "goofyfooted," meaning the right foot is in the front binding and the left foot is in the rear binding. Existing products do not provide reversibility so that one toe-hook may be applied to the snowboard, which can be reversed for both regular-footed and goofy-footed riders. A second problem that a snowboarder may encounter with existing products is the method of securing the straps. While current strap fasteners suit their intended purpose, hook and loop fasteners may become separated if the snowboarder is not giving the fastener his or her full attention.

The present invention provides methods and apparatuses for a toe-hook that is reversible such that one product can be utilized for both regular-footed and goofy-footed snowboarders. Further, the present invention comprises a novel and improved fastener to secure the straps of the toe-hook.

II. SUMMARY OF THE INVENTION

The present invention comprises an apparatus, namely, a snowboard accessory, which comprises a base and first and second straps operatively connected to the base. The straps are selectively removable from the base. The straps are adapted to secure a snowboarder's unbound foot to the base. Further, the straps are reversible such that a snowboarder's right foot can be attached to the base. Accordingly, it an object of the present invention to provide a toe-hook apparatus that is reversible such that a regular-footed rider or a goofy-footed rider may relieve stress on their knees and ankles when riding a chair lift.

Another object of the present invention is to provide an apparatus with an improved locking mechanism to secure the toe-hook straps to together.

Still, another object of the present invention is to provide an apparatus, wherein the base further comprises a first end and a second end, the first and second ends having an opening defined therein to receive each of the straps.

Further, another object of the present invention is to provide an apparatus, wherein the straps further comprise a locking mechanism to secure the foot to the base.

Yet, another object of the present invention is to provide an apparatus, wherein the first strap comprises a plurality of holes, and the second strap comprises a plurality of projections adapted to be engaged within the plurality of holes to secure the foot to the base.

Still yet, another object of the present invention is to provide an apparatus, wherein the second strap further comprises a locking tab adapted to prevent the projections from disengaging from the plurality of holes in the first strap.

Another object of the present invention is to provide an apparatus, wherein each of the straps further comprises a first end and a second end, wherein each of the second ends of the straps comprises a tab for engaging the base.

Further, another object of the present invention is to provide an apparatus, wherein the straps and the base are fabricated from a polymeric material.

Still, another object of the present invention is to provide an apparatus, wherein the apparatus is a snowboard accessory.

Another object of the present invention is to provide an apparatus, wherein the straps extend angularly from the base to secure the foot to the base.

It is yet another object of the present invention is to provide an apparatus, wherein at least one of the plurality of holes has a first shape and at least one of the plurality of holes has a second shape.

Still yet, another object of the present invention is to provide an apparatus, wherein each of the projections is adapted to register with the first shape and the second shape.

Another object of the present invention is to provide an apparatus, wherein the second strap further comprises a locking tab extending from an end of the second strap, the locking tab adapted to engage one of the plurality of holes having the first shape but not the second shape.

Further, another object of the present invention is to provide a method for utilizing a snowboard accessory, comprising the steps of:

providing a base and two straps operatively connected to the base, the straps being selectively removable from the base, wherein the straps are adapted to secure an associated left foot to the base, the straps also adapted to be reversed to secure an associated right foot to the base;

attaching the base to an associated snowboard;

attaching the first strap to the base;

attaching the second strap to the base;

forming a toe-hook with the first and second straps; and, inserting one foot into the toe-hook.

It is yet another object of the present invention to provide a method for utilizing a snowboard accessory, further comprising the steps of:

removing the foot from the toe-hook;

removing the first and second straps from the base;

reinserting the first and second straps into the base on the opposite side of the base relative to its original position;

forming a toe-hook with the first and second straps; and, inserting the other foot into the toe-hook.

Still yet, another object of the present invention is to provide a toe-hook for a snowboard, comprising:

a base attached to the snowboard, the base having first and second ends, each of the ends having an opening defined therein;

an elongated first strap having a first end and a second end, the second end having a tab extending therefrom, the tab adapted to be inserted into one of the openings in the base, the first strap having a plurality of holes defined therein, wherein at least one of the holes has an oval shape and at least one of the holes has a rectangular shape, the elongated first strap extending angularly from the base; and, an elongated second strap having a first end and a second end, the second end having a tab extending therefrom, the tab adapted to be inserted into one of the openings in the base, the first strap having a plurality of projections extending therefrom, the projections adapted to be securely inserted into the plurality of holes, the projections adapted to fit through the rectangular hole and the oval hole, the second strap having a locking tab extending from the first end, the locking tab adapted to only fit in the rectangular hole; wherein the straps are adapted to secure an associated left foot to the base, the straps also adapted to be reversed to secure an associated right foot to the base.

It is yet another object of the present invention to provide a snowboard accessory that is easy to use.

Another object of the present invention is to provide a snowboard accessory that is economical to manufacture.

Still other benefits and advantages of the invention will become apparent to those skilled in the art to which it pertains upon a reading and understanding of the following detailed specification.

III. BRIEF DESCRIPTION OF THE DRAWINGS

The invention may take physical form in certain parts and arrangement of parts, a preferred embodiment of which will be described in detail in this specification and illustrated in the accompanying drawings which form a part hereof and wherein.

IV. DESCRIPTION OF THE PREFERRED EMBODIMENT

Figure 1:
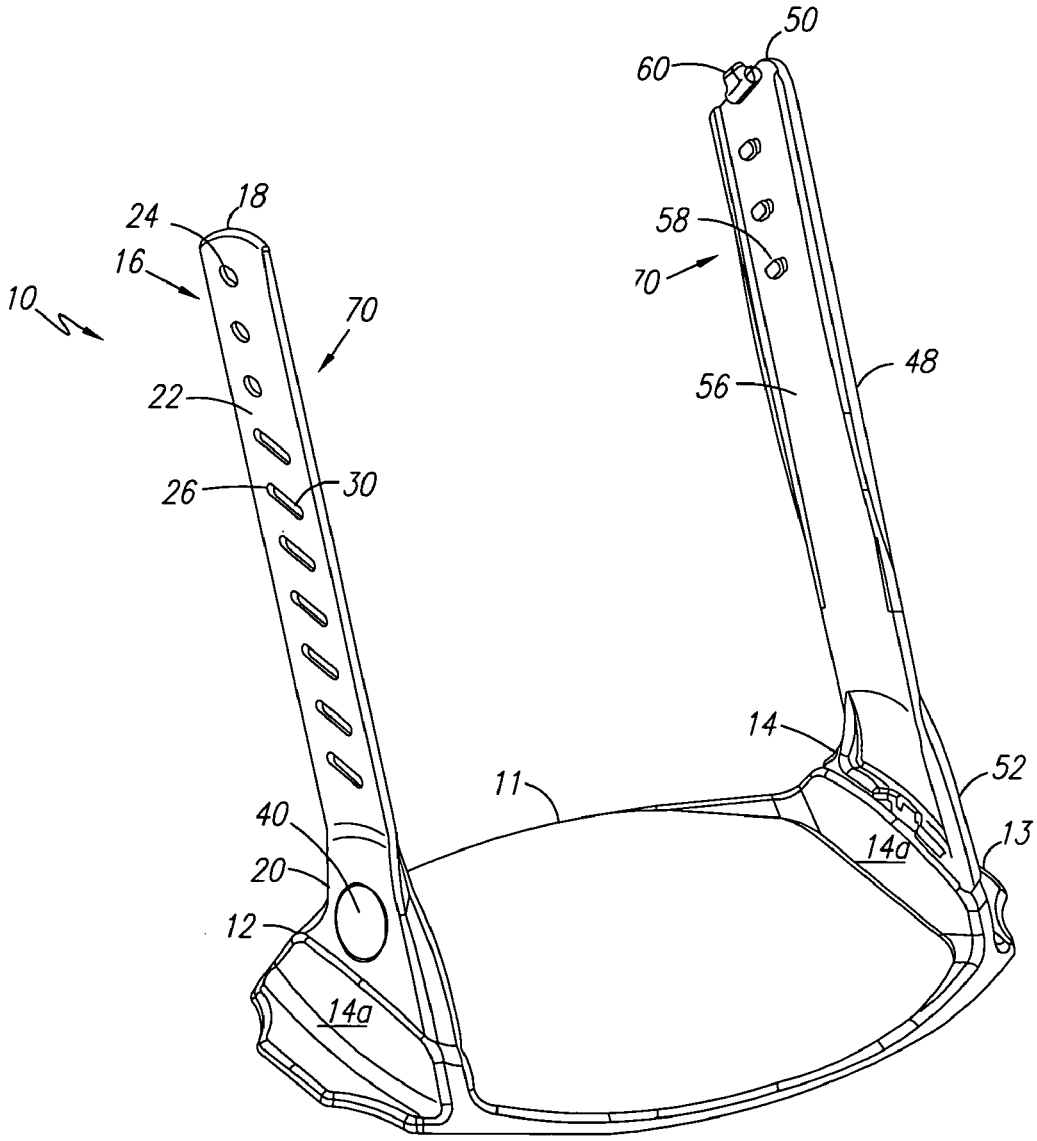
FIG. 1 is a left perspective view of the present invention.
Figure 2:
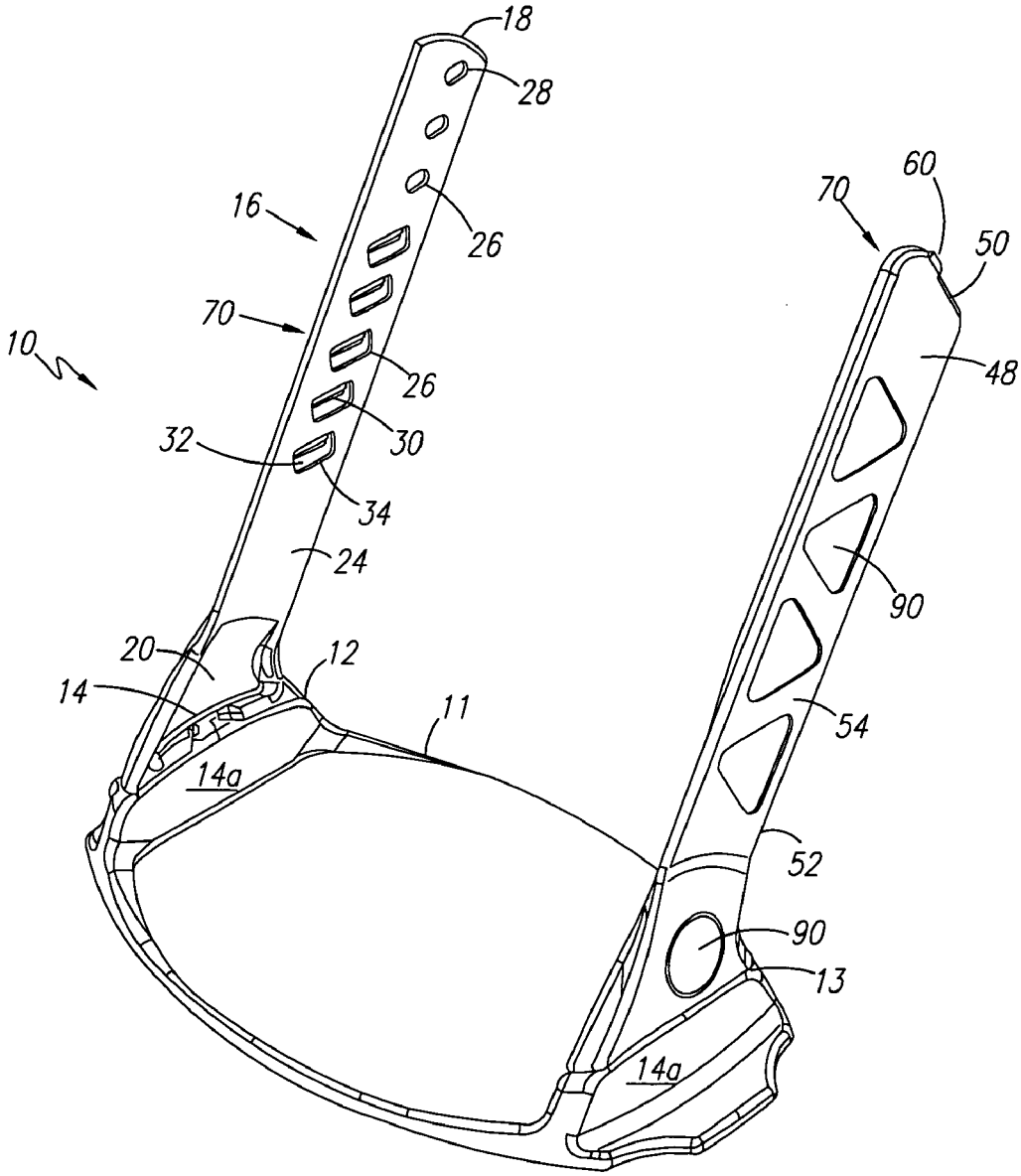
FIG. 2 is a right perspective side view of the present invention.
Figure 3:
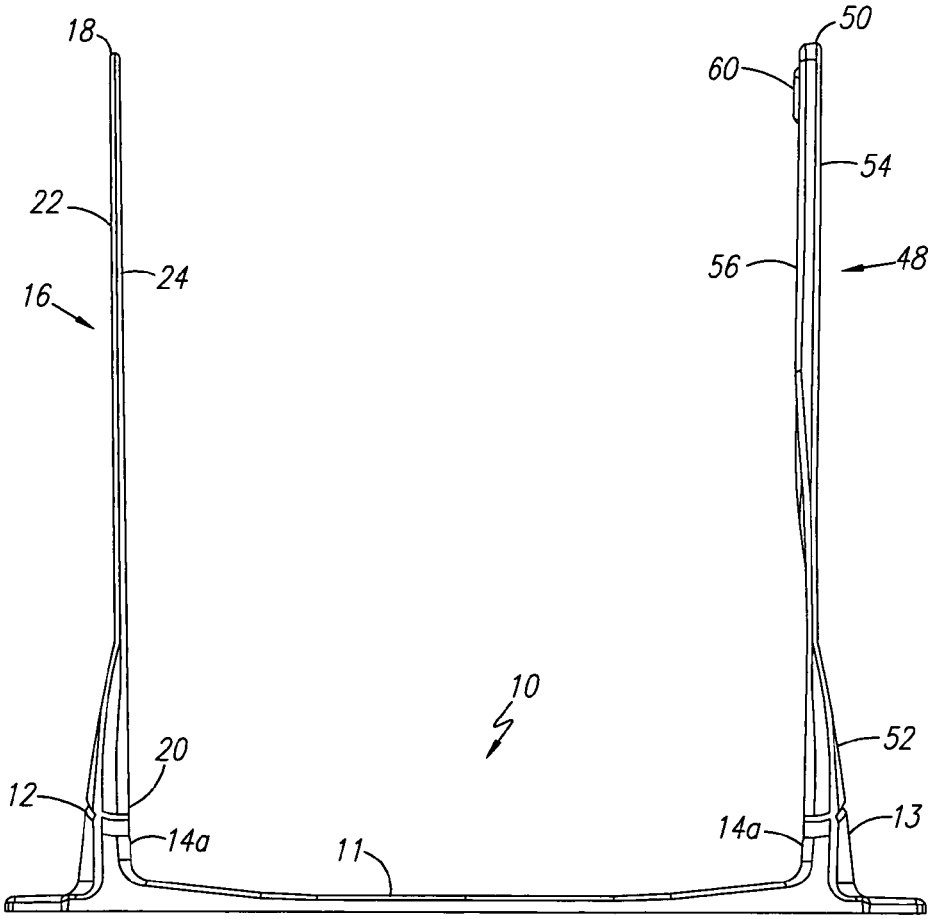
FIG. 3 is a rear elevational view of the present invention.
Figure 4:
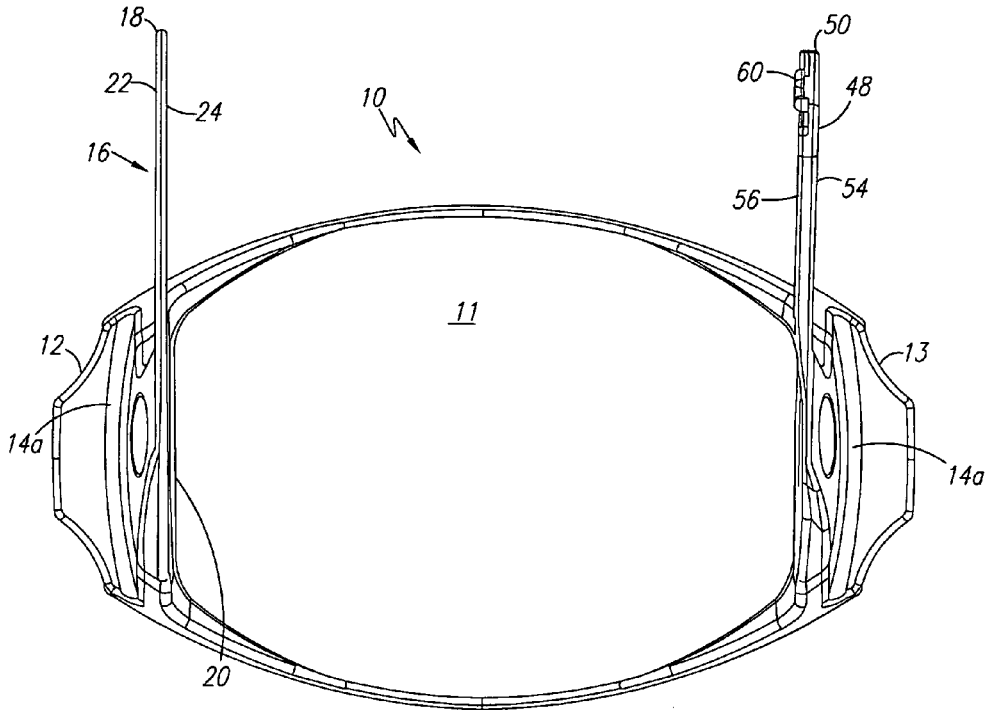
FIG. 4 is a top view of the present invention.
Figure 5:
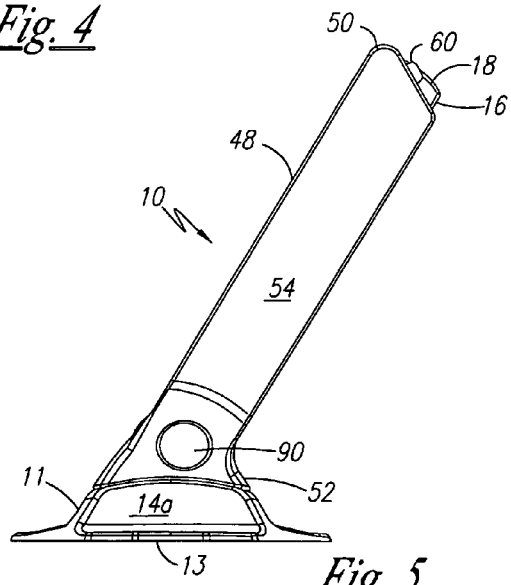
FIG. 5 is a side view of the present invention.

Referring now to the drawings wherein the showings are for purposes of illustrating a preferred embodiment of the invention only and not for purposes of limiting the same, FIGS. 1–20 show the present invention. With reference to FIGS. 1–5, the present invention is shown. An apparatus 10 in the form of a snowboard accessory comprises a base 11 with a first strap 16 and a second strap 48. The first and second straps 16, 48 are operatively connected to the base 11 and are selectively removable from the base 11. The straps 16, 48 are adapted to secure an associated left-foot 84 to the base 11. The straps 16, 48 are also adapted to be reversed to secure an associated right-foot 82 to the base 11. What is meant by the term "secure" is to bind the rider's foot to the snowboard. While the rider may position the straps 16, 48 as tight as desired, it is important that the rider be able to withdraw their foot from the apparatus 10 without disengaging the straps 16, 48 from each other or from the base 11.

Figure 6:
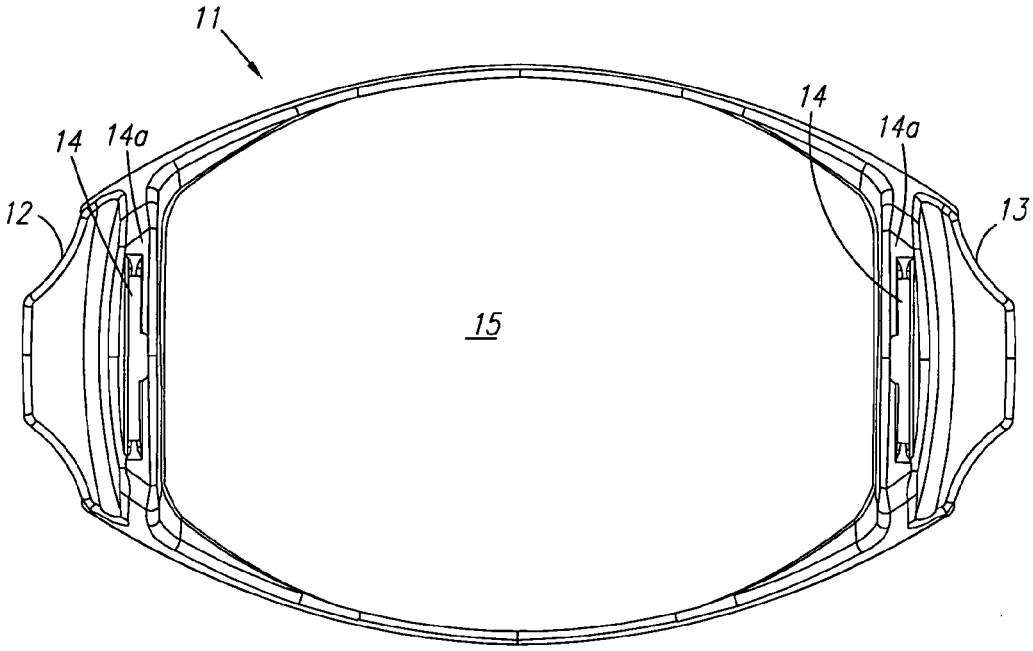
FIG. 6 is a top view of the base of the present invention.
Figure 7:
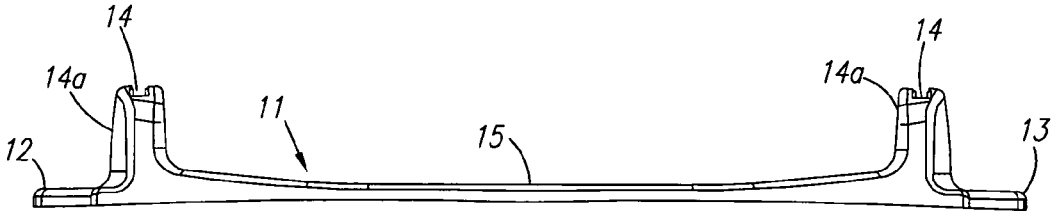
FIG. 7 is a front elevational view of the base.
Figure 8:
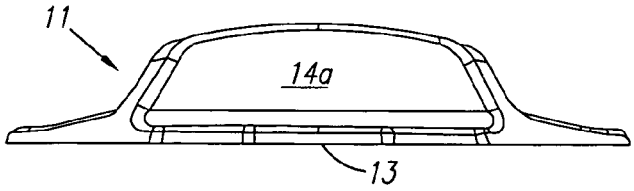
FIG. 8 is a side view of the base.
Figure 9:
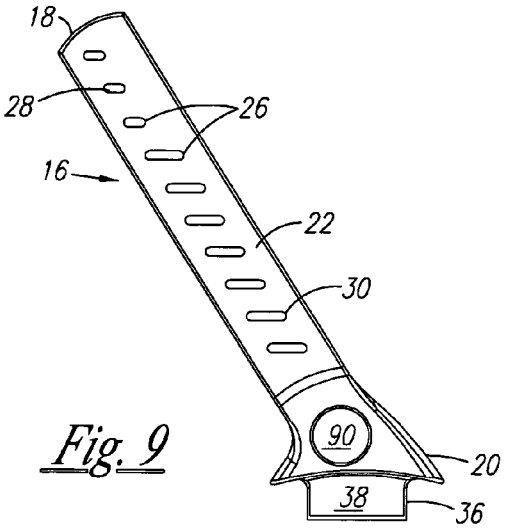
FIG. 9 is a side view of the outer surface of the first strap.

With particular reference to FIGS. 6–8, the base 11 will now be described in further detail. The base comprises a first end 12 and a second end 13. On each end 12, 13 a strap receiving portion 14*a* extends from the base 11. The strap receiving portion has elongated openings 14 defined therein. The base 11 has a center 15 for the placement of the right or left foot 82, 84 of the rider. The center 15 may further comprise a raised tread pattern to provide traction. It is also possible to place a decal in the center 15 of the base 11. As shown in FIG. 6, the openings 14 are elongated and are wider at the center than at the ends. The purpose for the wider portion of the opening 14 is for easy release of the straps 16, 48 as will be described in further detail below. The strap receiving portions 14*a* are integrally formed with the base 11. However, the strap receiving portion 14*a* may be connected in any way to the base 11 chosen with sound engineering judgment. The base 11 may also include an adhesive backing to adhere the base 11 to the snowboard 80. An example of an appropriate adhesive would include the 300LSE Laminating Adhesive produced by Minnesota Mining and Manufacturing Company of St. Paul, Minn. Of course, any adhesive may be utilized chosen with sound engineering judgment provided that the base remains adhered to the snowboard 80 through a wide range of temperatures, especially freezing temperatures.

Figure 10:
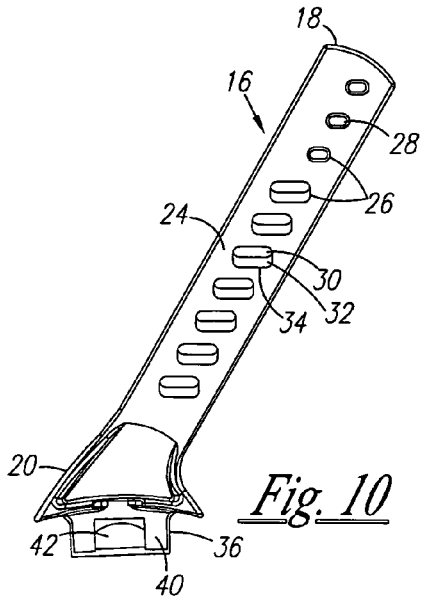
FIG. 10 is a side view of the inner surface of the first strap.
Figure 11:
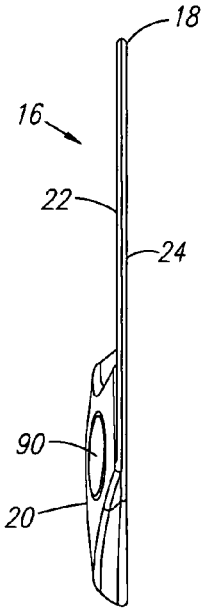
FIG. 11 is a top view of the first strap.
Figure 12:
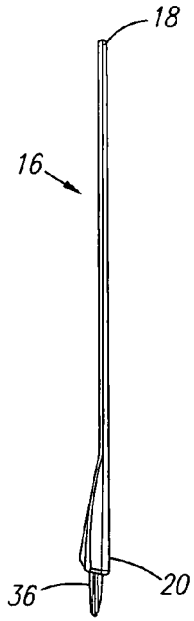
FIG. 12 is a rear view of the first strap.
Figure 13:
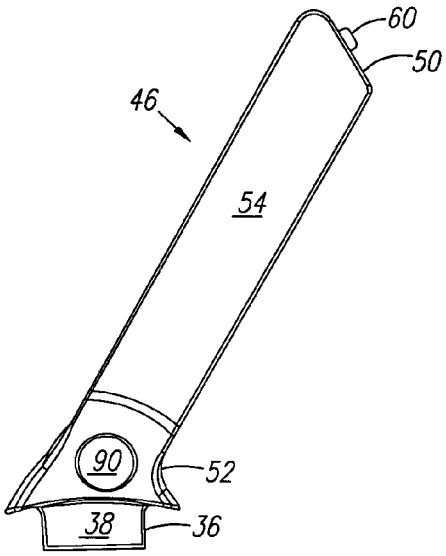
FIG. 13 is a side view of the outer surface of the second strap.
Figure 14:
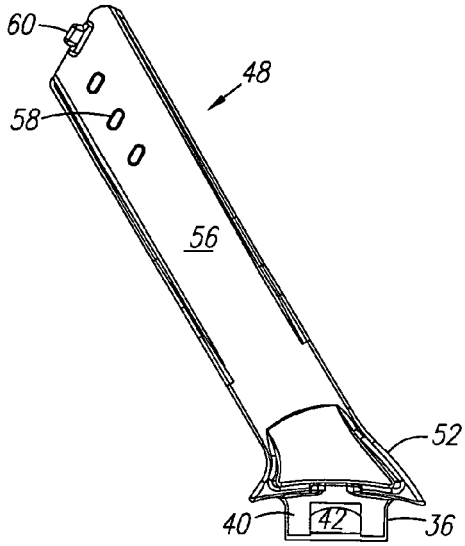
FIG. 14 is a side view of the inner surface of the second strap.
Figure 15:
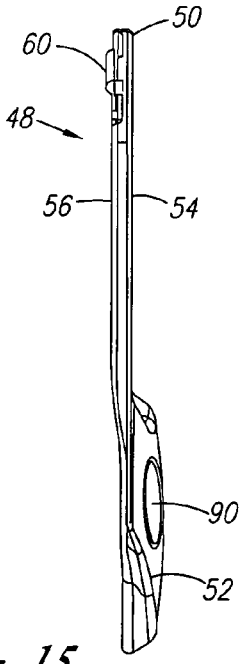
FIG. 15 is a top view of the second strap.
Figure 16:
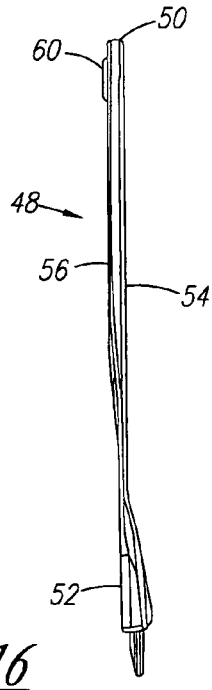
FIG. 16 is a rear view of the second strap.

With reference to FIGS. 9–12, the first strap 16 will now be described. The first strap 16 has a first end 18 and second end 20. Further, the first strap 16 comprises an outer surface 22 and an inner surface 24. The first strap 16 has a plurality of holes defined therein. Any number of holes may be chosen in accordance with sound engineering judgment. As shown in the FIGURES, the plurality of holes 26 may have different shapes, and more specifically, the first three shapes 28 may be oval, whereas the second shapes 30 may be longer than the oval holes or even rectangular. With reference to FIG. 10, the inner surface 24 of the first strap 16 is shown. In this view, the second shaped holes 30 are shown, wherein a recess 32 is defined in the first strap 16 so as to form a ledge 34 with the inner surface 24. The hole 30 is defined within the recess 32 and extends through the first strap 16.

With continuing reference to FIGS. 9–12, a tab 36 extends in perpendicular fashion from the second end 20 of the first strap 16. The tab has an outer surface 38 and an inner surface 40. A lip 42 extends from the inner surface 40 of the tab 36. The tab 36 is adapted to be inserted to the opening 14 of the strap receiving portions 14*a*. The lip 42 extends outward from the tab 36 to provide for tight engagement between the first strap 16 and the base 11. The lip 42 is positioned in the opening 14. The center of the opening 14 is wider than the ends. The wider portion of the opening 14 still has ample room for an instrument to be inserted therein to push against the lip 42 in order to release the first strap 16 from the base 11. Also, in FIGS. 9 and 11, decals may be positioned at 90 if desired.

With reference for FIGS. 13–16, the second strap 48 is shown. The second strap has a first end 50 and a second end 52. The second strap 48 also has an outer surface 54 and an inner surface 56. With specific reference to FIG. 14, a plurality of projections 58 extends from the inner surface 56 of the second strap 48. Extending from the first end 50 of the second strap 48 is a locking tab 60. The plurality of projections 58 in conjunction with locking tab 60 and the plurality of holes 26 of the first strap 16 comprise the locking mechanism 70 of the present invention. The plurality of projections 58 are adapted to fit into any of the plurality of holes 26 of the first strap 16. However, the locking tab 60 is adapted to only fit in the second shaped holes 30 of the first strap 16. When the locking tab 60 is inserted into one of the second shaped holes 30, it passes through the second shaped hole 30 and engages the recess 32. This attachment will prevent the second strap 48 from disengaging from the first strap 16. As shown in the FIGURES, at least three projections 58 will engage with the holes 26 of the first strap. Any number may be chosen in accordance with sound engineering judgment. With continuing reference to FIGS. 13–16, the tab 36 extends from the second end 52 of the second strap 48. As with the first strap 16, the tab 36 of the second strap has an outer surface 38 and an inner surface 40. The inner surface of the tab 42 has a lip 42 extending therefrom as previously described.

Figure 20:
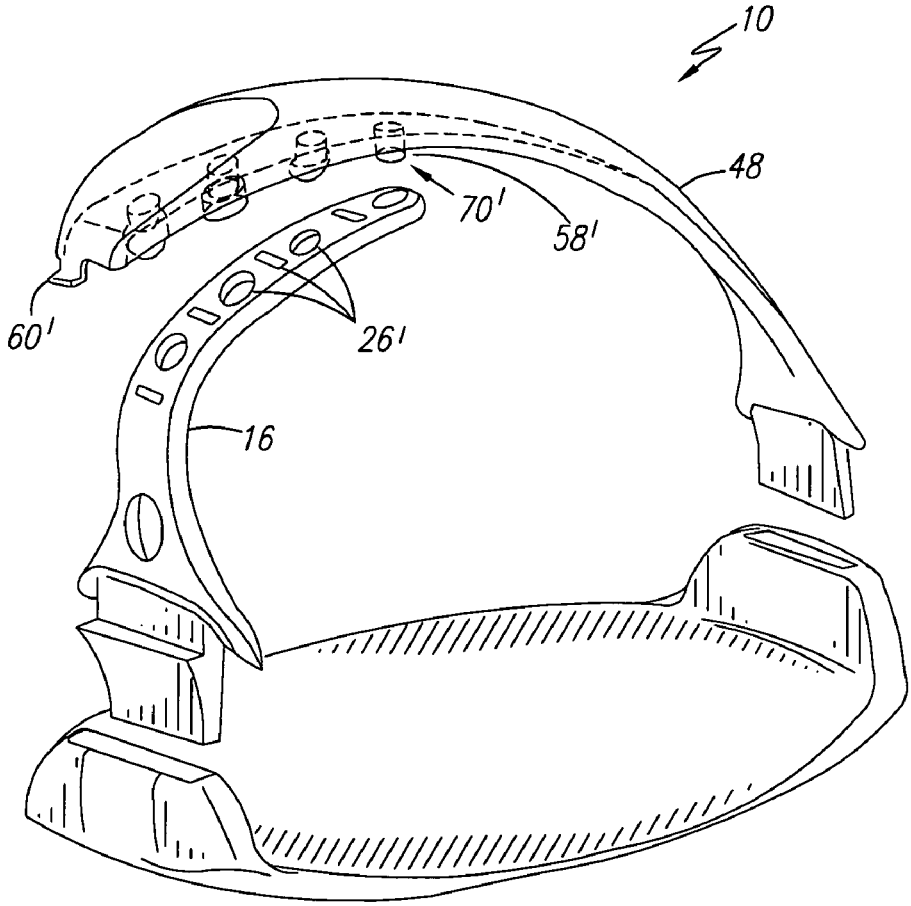
FIG. 20 is a perspective view of another embodiment of a locking mechanism.

In another embodiment, as shown in FIG. 20, another locking mechanism 70 is shown. In this embodiment, the first strap 16 has a plurality of holes 26', which are substantially circular. Following each circular hole is a rectangular hole. On the second strap 48, the plurality of projections 58' extend from the inner surface of the second strap 48. A locking tab 60' also extends from the first end 50 of the second strap 48. In this embodiment, each of the projections 58' engage the oval holes 26'. The locking tab 60' engages one of the rectangular holes.

The first and second straps 16, 48 are angled relative to a horizontal surface to provide for proper fit around the right or left foot 82, 84 and to properly engage with each other. Further, the plurality of holes 26 of the first strap 16 are positioned in an angular relationship relative to the horizontal surface so that they can properly engage with the second strap 48. Likewise, the plurality of projections 58 of the second strap 48 is positioned at an angle. The angular extension of the straps 16, 48 provides for an angled toe-hook, which follows the general contour of the rider's boot. As such, this results in an improved fit. Further, the angle of the straps 16, 48 enables the reversibility of the snowboard accessory 10.

Figure 17:
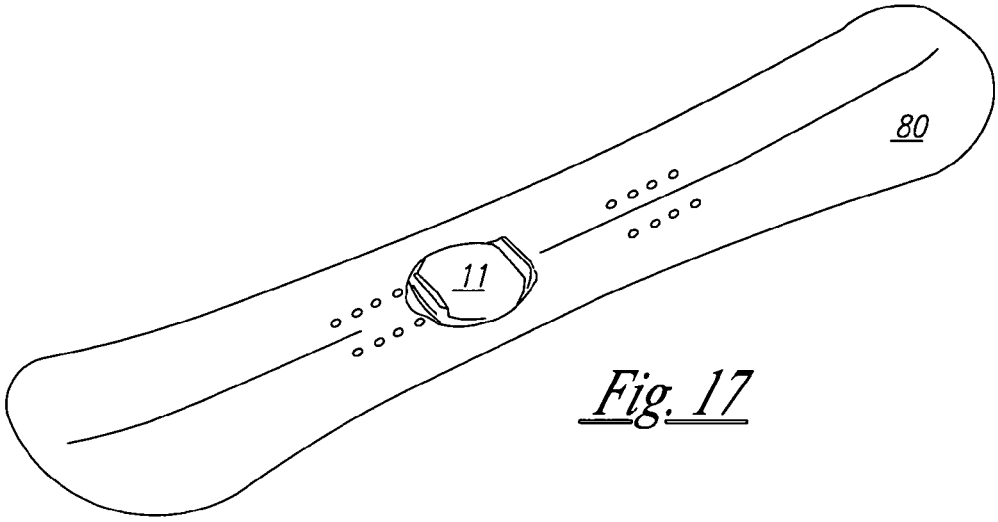
FIG. 17 is a perspective view of the base attached to the snowboard.
Figure 18:
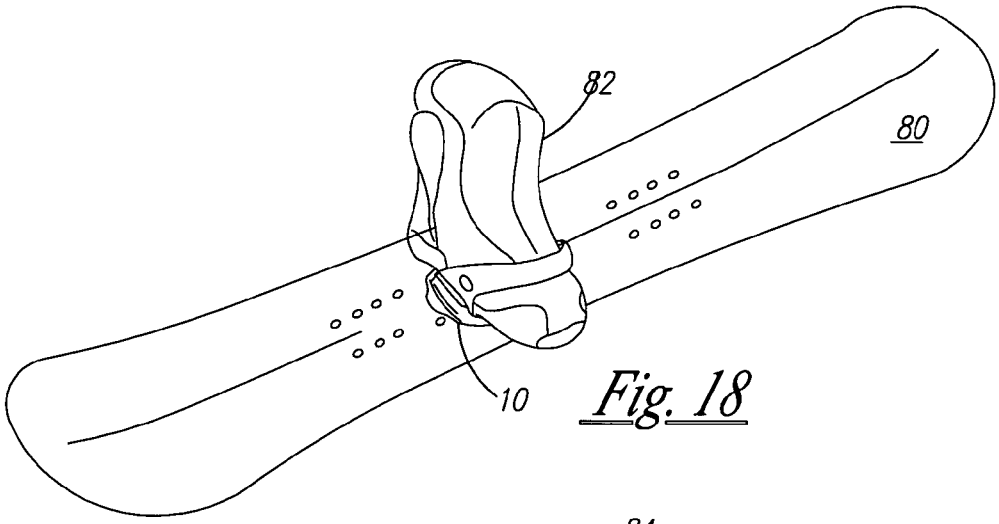
FIG. 18 is a perspective view of the straps mounted to the base for a regular-footed snowboarder.
Figure 19:
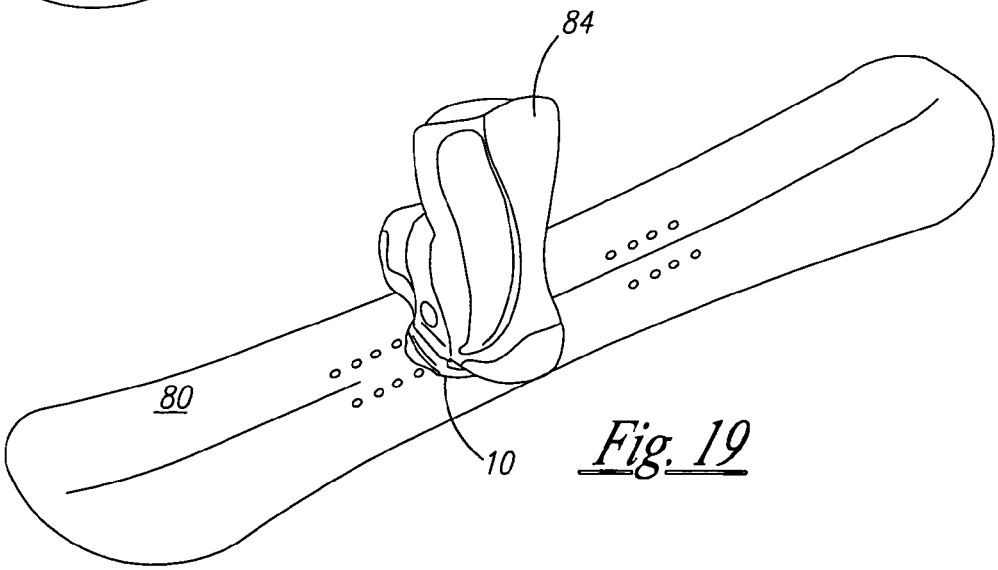
FIG. 19 is a perspective view of the straps mounted to the base for a goofy-footed snowboarder.

With reference to FIGS. 17–19, a perspective of the present view of the present invention is shown wherein the base 11 is attached to a snowboard 80. As shown in FIG. 18, a regular-footed snowboarder has his/her foot positioned within the present invention. As shown in FIG. 19, a goofy-footed rider has their left foot 84 positioned within the present invention.

The straps 16, 48 and base 11 may be fabricated from a polymeric material chosen in accordance with sound engineering judgment. Further, any molding process may be utilized to manufacture the present invention, including without limitation, injection molding.

In order to utilize the present invention, a snowboard accessory or apparatus 10 as previously described is provided. The base 11 is attached, preferably adhesively bound, to a snowboard and preferable in front of the rear binding. However, it could also be mounted anywhere in between the front and the rear bindings. The base 11 should be positioned such that its longitudinal centerline coincides with the longitudinal centerline of the snowboard 80. Alternately, the base could be mounted at an angle relative to the longitudinal centerline, or off center. The base 11 should be positioned such that its longitudinal centerline coincides with the longitudinal centerline of the snowboard 80. Alternately, the base could be mounted at an angle relative to the longitudinal centerline, or off center. The straps 16, 48 are attached to the base 11 through tab 36 and holes 14. A toe hook is formed by properly engaging the plurality of projections 58 into the plurality of holes 26. One foot of the snowboarder is removed from the snowboard binding and inserted into the toe-hook. In this manner, one foot is rigidly affixed to the snowboard by the snowboard binding, while the other foot supports the snowboard through the use of the present invention. This thereby allows the user to support the snowboard with both feet while ascending the hill on the ski-lift, or control while exiting. Should the user want to change his or her "stance" such that the opposite feet are rigidly connected/loosely held respectively, the first and second straps 16,48 are removed from the base 11. This may be done through the use of a tool, such as a screwdriver which is inserted into the wider portion of the opening 14. Pressure is applied against the tab 36 and/or the lip 42 that allows for releasing of the strap. The straps are then reinserted into the holes 14 and the base 11 on opposites sides of the base 11 relative to their original position. Again, a toe-hook is formed with the first and second straps 16,48 by engaging the plurality of projections 58 into the plurality of holes 26.

In any event, the present invention is positioned for use while riding the chair lift, exiting the chair lift, or while performing professional tricks. The rider simply removes a rear foot from the snowboard bindings and maneuvers himself or herself to the chair lift. (It should be noted that riders are not allowed to have both feet attached to the snowboard bindings while riding the chairlift, but such is necessary while snowboarding). Once seated on the chair lift, the rider positions their free or loose foot within the toe-hook formed and thereby supports the snowboard with both feet while riding the chairlift. Once the rider is at the too of the hill or mounting, he or she is able to easily maneuver off of the chairlift as normal.

The foregoing descriptions of specific embodiments of the present invention have been presented for purposes of illustration and description. They are not intended to be exhaustive or to limit the invention to the precise forms disclosed, and obviously many modifications and variations are possible in light of the above teaching. The embodiments were chosen and described in order to best explain the principles of the invention and its practical application, to thereby enable others skilled in the art to best utilize the invention and various embodiments with various modifications as are suited to the particular use contemplated. It is intended that the scope of the invention be defined by the claims appended hereto and their equivalents. Therefore, the scope of the invention is to be limited only by the following claims.

What is claimed is:

1. A snowboard accessory comprising:

a base having a first end and a second end, said base operatively connected to an associated snowboard;

a first strap and a second strap each attached to said base, said straps being selectively removable from said base, said straps having a locking mechanism so as to bind said snaps to each other, wherein said locking mechanism comprises a plurality of projections extending from said second strap, a locking tab extending from an end of said second strap and a plurality of holes defined in said first strap;

wherein each of said projections is adapted to register with one of said plurality of holes in said first strap, at least one of said plurality of holes has a first shape and at least one of said plurality of holes has a second shape, wherein each of said projections is adapted to register wit said first shape and said second shape, said locking tab adapted to engage one of said plurality of holes having said first shape but not said second shape.

2. The snowboard accessory of claim 1, wherein said first shaped holes are oval shaped.

3. The snowboard accessory of claim 1, wherein said straps are adapted to secure an associated left foot to said base, said straps also adapted to be reversed to secure an associated right foot to said base.

4. The snowboard accessory of claim 1, wherein said base further comprises a first end and a second end, said first and second ends each having an opening defined therein for receiving said first and second straps.

5. The snowboard accessory of claim 1, wherein said first strap has a recess, said recess having said second shaped hole defined therein, said recess defining a ledge with an inner surface of said first strap.

6. The snowboard accessory of claim 5, wherein said locking tab is adapted to pass trough said second hole and engage said recess.

7. The snowboard accessory of claim 1, wherein said base and said straps are fabricated from a polymeric material.

8. The snowboard accessory of claim 7, wherein each of said straps further comprises a first end and a second end, wherein each of said second ends of said straps comprises a tab for engaging said base via said openings.

9. A method for utilizing the snowboard accessory of claim 1, said method comprising the steps of:

providing a base;

providing a first strap and a second strap, each said strap operatively connected to said base, said straps being selectively removable from said base;

adapting said first strap and said second strap to secure an associated left foot to said base;

adapting said first strap and said second strap to be reversed to secure an associated right foot to said base;

attaching said base to an associated snowboard;

attaching said first strap to said base;

attaching said second strap to said base;

forming a toe-hook with said first and second straps; and, inserting one foot into said toe-hook.

10. The method of claim 9, further comprising the steps of reinserting said first and second straps into said base on the opposite side of said base relative to its original position;

forming a toe-hook wit said first and second straps; and, inserting one foot into said toe-hook.

11. A toe-hook for a snowboard, comprising:

a base attached to the snowboard, said base having first and second ends, each of said ends having an opening defined therein;

an elongated first strap having a first end and a second end, said second end having a tab extending therefrom, said tab adapted to be inserted into one of said openings in said base, said first strap having a plurality of holes defined therein, wherein at least one of said holes has an oval shape and at least one of said holes has a rectangular shape, said elongated first strap extending angularly from said base; and, an elongated second strap having a third end and a fourth end, said fourth end having a tab extending therefrom, said tab adapted to be inserted into one of said openings in said base, said second strap having a plurality of projections extending therefrom, said projections adapted to be securely inserted into said plurality of holes, said projections adapted to fit through said rectangular hole and said oval hole, said second strap having a locking tab extending from said first end, said locking tab adapted to only fit in said rectangular hole; wherein said straps are adapted to secure an associated left foot to said base, said straps also adapted to be reversed to secure an associated right foot to said base.

12. A stomp pad for use with an otherwise conventional snowboard, said stomp pad comprising:

a base adapted to be attachable to a snowboard and having a first end forming a first opening opposite a second end forming a second opening;

a first strap operatively connected to said first opening, said first strap adapted to secure an associated left foot to said base, said first strap also adapted to be reversed to secure an associated right foot to said base;

a second strap operatively connected to said second opening, said second strap adapted to secure an associated right foot to said base, said second strap also adapted to be reversed to secure an associated left foot to said base, wherein said straps further comprise a locking mechanism; and connection means for connecting said first strap to said second strap thereby forming a toe-hook therebetween.

13. The stomp pad of claim 12, further comprising adjustment means for adapting said connection means in a manner to adjust the size of said toe-hook.

14. The stomp pad of claim 12, wherein said connection means comprises said first strap comprises a plurality of holes, said second strap further comprises a plurality of projections adapted to be engaged within said plurality of holes.

15. The stomp pad of claim 14, wherein said second strap further comprises a locking tab adapted to prevent said projections from disengaging from said plurality of holes in said first strap.

16. The stomp pad of claim 12, wherein said straps are fabricated from a polymeric material.

17. The stomp pad of claim 12, wherein said first strap and said second strap each extend angularly from said base.

* * * * *